US009797207B2

(12) United States Patent
McIntosh et al.

(10) Patent No.: US 9,797,207 B2
(45) Date of Patent: Oct. 24, 2017

(54) ACTUATOR ASSEMBLY FOR TUBULAR RUNNING DEVICE

(71) Applicant: 2M-TEK, Inc., Scott, LA (US)

(72) Inventors: Richard McIntosh, Lafayette, LA (US); Ian Corse, Scott, LA (US)

(73) Assignee: 2M-TEK, Inc., Scott, LA (US)

( * ) Notice: Subject to any disclaimer, the term of this patent is extended or adjusted under 35 U.S.C. 154(b) by 0 days.

(21) Appl. No.: 15/056,587

(22) Filed: Feb. 29, 2016

(65) Prior Publication Data

US 2016/0177639 A1 Jun. 23, 2016

Related U.S. Application Data

(63) Continuation-in-part of application No. 13/980,769, filed as application No. PCT/US2012/021820 on Jan. 19, 2012, now Pat. No. 9,273,523.

(60) Provisional application No. 61/435,157, filed on Jan. 21, 2011.

(51) Int. Cl.
*E21B 19/06* (2006.01)
*E21B 31/20* (2006.01)

(52) U.S. Cl.
CPC ..... *E21B 19/06* (2013.01); *E21B 31/20* (2013.01)

(58) Field of Classification Search
CPC ..... E21B 19/06; E21B 31/20
See application file for complete search history.

(56) References Cited

U.S. PATENT DOCUMENTS 5,967,477 A * 10/1999 Walmsley ..... E21B 19/06 248/230.2
6,752,569 B2 * 6/2004 Emmett ..... F16L 55/132 138/93
7,073,598 B2 * 7/2006 Haugen ..... E21B 19/00 166/380
7,191,840 B2 * 3/2007 Pietras ..... E21B 19/00 166/380
7,445,050 B2 * 11/2008 Kuttel ..... E21B 19/06 166/380
7,552,764 B2 * 6/2009 Weems ..... B66C 1/42 166/75.14
7,744,140 B2 * 6/2010 Rowley ..... F16B 2/16 294/94
7,874,352 B2 * 1/2011 Odell, II ..... E21B 19/06 166/75.14
7,909,120 B2 3/2011 Slack
8,424,939 B2 4/2013 Slack
8,454,066 B2 6/2013 Slack (Continued)

*Primary Examiner* — Michael Wills, III
(74) *Attorney, Agent, or Firm* — Lloyd L. Davis; Andrews Kurth Kenyon LLP

(57) ABSTRACT

An actuator assembly for operating a tubular running device includes a housing assembly coupled to the outer cage. The housing assembly is movable relative to the inner mandrel. An upper fluid chamber is disposed between the housing assembly and the inner mandrel, and a lower fluid chamber is disposed between the housing assembly and the inner mandrel. Fluid pumped through an upper pressure port into the upper chamber moves the housing assembly in a first direction thereby causing the gripping apparatus to engage the tubular, and fluid pumped through a lower pressure port into the lower fluid chamber moves the housing assembly in a second direction thereby causing the gripping apparatus to disengage the tubular.

8 Claims, 4 Drawing Sheets

(56) References Cited

U.S. PATENT DOCUMENTS

| | | | | |
|---|---|---|---|---|
| 8,720,542 | B2 * | 5/2014 | Hughes | E21B 19/07 166/380 |
| 9,273,523 | B2 * | 3/2016 | McIntosh | E21B 19/06 |
| 2010/0163248 | A1 * | 7/2010 | Robichaux | E21B 43/10 166/381 |

* cited by examiner

ACTUATOR ASSEMBLY FOR TUBULAR RUNNING DEVICE

CROSS-REFERENCE TO RELATED APPLICATIONS

This application is a continuation-in-part and claims benefit under 35 U.S.C. §120 of U.S. patent application Ser. No. 13/980,769, filed Jul. 19, 2013, to issue on Mar. 1, 2016 as U.S. Pat. No. 9,273,523, which claimed priority to U.S. Provisional Application No. 61/435,157, filed on Jan. 21, 2011, both of which are incorporated by reference herein in their entireties.

FIELD

Embodiments disclosed herein relate to an actuator assembly for a tubular running device used for gripping and handling of tubular members.

BACKGROUND

In the construction of oil or gas wells it is usually necessary to line the wellbore with a string of steel pipes commonly known as a "tubular" or tubing or generically as oil country tubular goods ("OCTG"). Because of the length of the tubular string required, individual sections of tubular are typically progressively added to the string in the wellbore as it is lowered into a well from a drilling rig or platform. The section to be added is restrained from falling in to the well by some tubular engagement means, typically a spider, and is lowered into the well to position the threaded pin of the tubular adjacent the threaded box of the tubular in the wellbore. The sections are then joined by relative rotation of the sections until such time as the desired total length has been achieved.

BRIEF SUMMARY OF THE INVENTION

In one aspect, embodiments disclosed herein relate to a tubular running device including a gripping apparatus at a lower end and an actuator assembly at an upper end. The gripping apparatus includes an outer cage concentrically disposed about an inner mandrel and movable relative to the inner mandrel for engaging and disengaging a plurality of rolling supports with a tubular, and an actuator assembly for moving the outer cage. The actuator assembly includes a housing assembly coupled to the outer cage, and the housing assembly is movable relative to the inner mandrel. An upper fluid chamber is disposed between the housing assembly and the inner mandrel, and a lower fluid chamber is disposed between the housing assembly and the inner mandrel. Fluid pumped through an upper pressure port into the upper chamber moves the housing assembly in a first direction thereby causing the gripping apparatus to engage the tubular, and fluid pumped through a lower pressure port into the lower fluid chamber moves the housing assembly in a second direction thereby causing the gripping apparatus to disengage the tubular.

In another aspect, embodiments disclosed herein relate to a method of operating a tubular running device including a gripping apparatus at a lower end and an actuator assembly at an upper end. The gripping apparatus includes an outer cage concentrically disposed about an inner mandrel and movable relative to the inner mandrel for engaging and disengaging a plurality of rolling supports with a tubular. The method includes providing an actuator assembly for moving the outer cage, the actuator assembly including a housing assembly coupled to the outer cage, and an upper fluid chamber defined between the housing assembly and the inner mandrel, and a lower fluid chamber defined between the housing assembly and the inner mandrel. The method further includes pumping fluid into the upper chamber and moving the housing assembly axially relative to the inner mandrel in a first direction thereby causing the gripping apparatus to engage the tubular.

DETAILED DESCRIPTION

Figure 1:
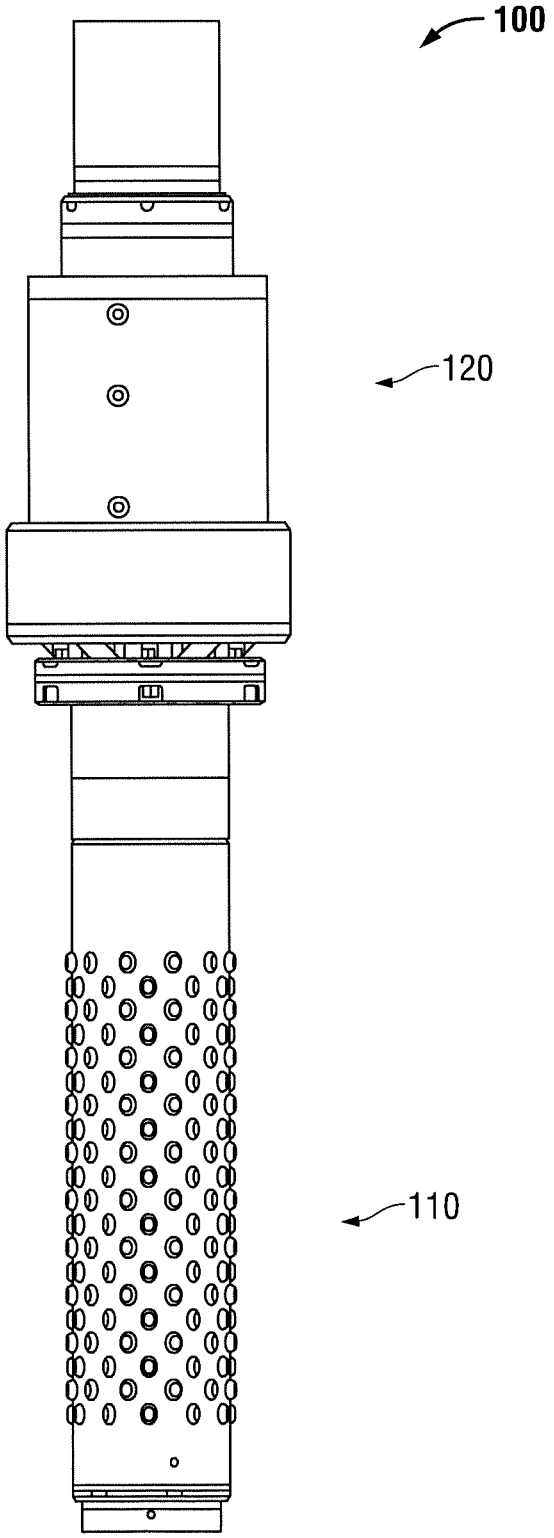
FIG. 1 illustrates a side view of an embodiment of a tubular running device and actuator assembly for operating the tubular running device.

Embodiments disclosed herein relate to an actuator assembly for a tubular running device used for gripping and handling of tubular members. The tubular running device is connectable to a top drive and may be used to grip the tubular OCTG from the inside or the outside. A rig operator may use existing rig equipment, such as a transfer elevator, to pick up and position a tubular OCTG above a tubular OCTG already secured in the rotary table on the drill floor. The operator may then use the tubular running device to grip the tubular OCTG and use the rotational capability of the top drive to couple the two joints of tubular OCTG together, that is "make up." Similarly, the rotational capability of the top drive may be used to decouple two joint of tubular OCTG, that is "break out." The tubular running device includes a gripping apparatus disposed at a lower end to grip tubular OCTG, and an actuator assembly disposed at an upper end for actuating the gripping apparatus to grip tubular OCTG. The gripping apparatus generally includes a first member (e.g., a probe or inner mandrel) having a plurality of indentations formed in an outer surface. Each indentation has an inclined surface angled relative to a longitudinal axis of the first member. The gripping apparatus further includes a second member (e.g., an outer cage) concentrically disposed relative to the first member. The second member has a plurality of openings through which a plurality of rolling supports disposed within respective indentations of the first member may protrude. Movement of the second member relative to the first member urges the rolling supports along the inclined surfaces of indentations of the first member. Operating the actuator assembly causes relative movement of the outer cage with respect to the inner mandrel to cause the rolling supports to move along the inclined surfaces of the indentations. The rolling supports are configured to protrude at least partially from the openings in the outer cage and engage the OCTG tubular. Thereafter, rotational torque may be applied by the top drive (not shown) to connect the tubular to its respective partner secured in the rotary table. A tubular running device has been described in detail by, for example, U.S. patent application Ser. No. 13/980,769, which is incorporated by reference herein in its entirety.

In one embodiment the actuator assembly includes a series of hydraulic or pneumatic fluid chambers, which when filled with fluid directly move the outer cage relative to the inner mandrel. A sleeve is fixed at an upper end and lower end about an outer surface of the inner mandrel. The fixed sleeve is configured having an outer circumferential flange protruding radially outward. Alternatively, a circumferential flange may be integrally disposed on the inner mandrel itself. A movable outer housing assembly includes an outer housing attached between an upper end cap at an upper end and a hub assembly at a lower end. The movable outer housing assembly is disposed concentrically about the fixed sleeve and flange. The upper end cap and hub assembly sealingly engage an outer surface of the fixed sleeve, and the outer housing sealingly engages an outer surface of the flange of the fixed sleeve.

The hub assembly disposed at a lower end of the outer movable housing directly engages the outer cage and is capable of moving the outer cage to travel axially relative to the movement of the inner mandrel. A bump stop ring is attached by fasteners to a lower portion of the hub assembly. The bump stop ring includes two plates fastened together—an upper steel plate and a lower shock-absorbing plate made from a shock-absorbing material such as carbon fiber. A mandrel ring is fixed to the inner mandrel and engages a lower end of the fixed sleeve. The mandrel ring is configured to limit axial movement of the hub assembly 130 along the length of the inner mandrel.

An upper chamber is defined above the flange on the fixed sleeve and below the upper end cap, and between the outer surface of the fixed sleeve and the inner surface of the movable outer housing. A lower chamber is defined below the flange on the fixed sleeve and above the hub assembly, and between the outer surface of the fixed sleeve and the inner surface of the movable outer housing. An upper port extends radially through the movable outer housing and provides fluid communication into the upper chamber. A lower port extends radially through the movable outer housing and provides fluid communication into the lower chamber. The upper port and the lower port may each be fitted with a pilot operated check valve configured to be closed to prevent fluid from exiting the upper chamber and lower pressure, respectively.

A floating piston may be disposed in the lower chamber and is configured to move axially therein. A gas chamber is defined below the floating piston and above the hub assembly, and between the outer surface of the fixed sleeve and the inner surface of the movable outer housing. The gas chamber may be filled or pre-charged with a gas or gas mixture—such as nitrogen or similar gases—at a certain pressure. For example, the gas chamber may be pre-charged to a pressure of at least 500 pounds per square inch (psi), or at least 1,000 psi, or at least 1,500 psi, or greater. A floating piston stop, configured as a radially inwardly protruding lip, may be disposed on an inner surface of the movable outer housing configured to limit upward movement of the floating piston.

Figure 2:
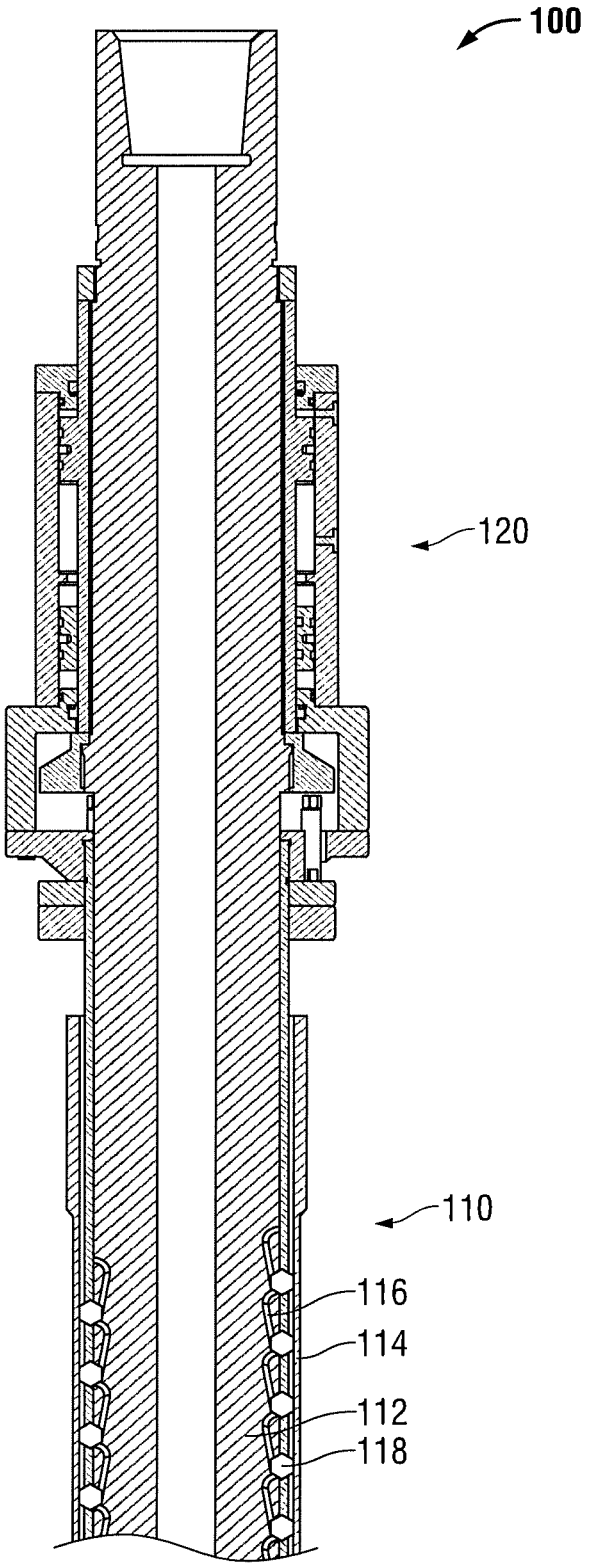
FIG. 2 illustrates a section view of an embodiment of a tubular running device and actuator assembly for operating the tubular running device.

FIG. 1 illustrates a side view of an embodiment of a tubular running device 100. The tubular running device 100 includes a gripping apparatus 110 disposed at a lower end to grip tubular OCTG, and an actuator assembly 120 disposed at an upper end for actuating the gripping apparatus to grip tubular OCTG. FIG. 2 illustrates a section view of an embodiment of a tubular running device 100. The gripping apparatus 110 includes a first member 112 (e.g., a probe or inner mandrel) having a plurality of indentations 116 formed in an outer surface. Each indentation 116 has an inclined surface angled relative to a longitudinal axis of the first member 112. The gripping apparatus 110 further includes a second member 114 (e.g., an outer cage) concentrically disposed relative to the first member 112. The second member 114 has a plurality of openings through which a plurality of rolling supports 118 disposed within respective indentations 116 of the first member 112 may protrude. Movement of the second member 114 relative to the first member 112 urges the rolling supports 118 along the inclined surfaces of indentations 116 of the first member 112. Operating the actuator assembly 120 in a manner described herein causes relative movement of the outer cage 114 with respect to the inner mandrel 112 to cause the rolling supports 118 to move along the inclined surfaces of the indentations 116. The rolling supports 118 are configured to protrude at least partially from the openings in the outer cage 114 and engage the OCTG tubular. Thereafter, rotational torque may be applied by the top drive (not shown) to connect the tubular to a tubular secured in the rotary table. The tubular running device 100 further includes an actuator assembly 120 disposed at an upper end to operate the gripping apparatus 110.

Figure 3A:
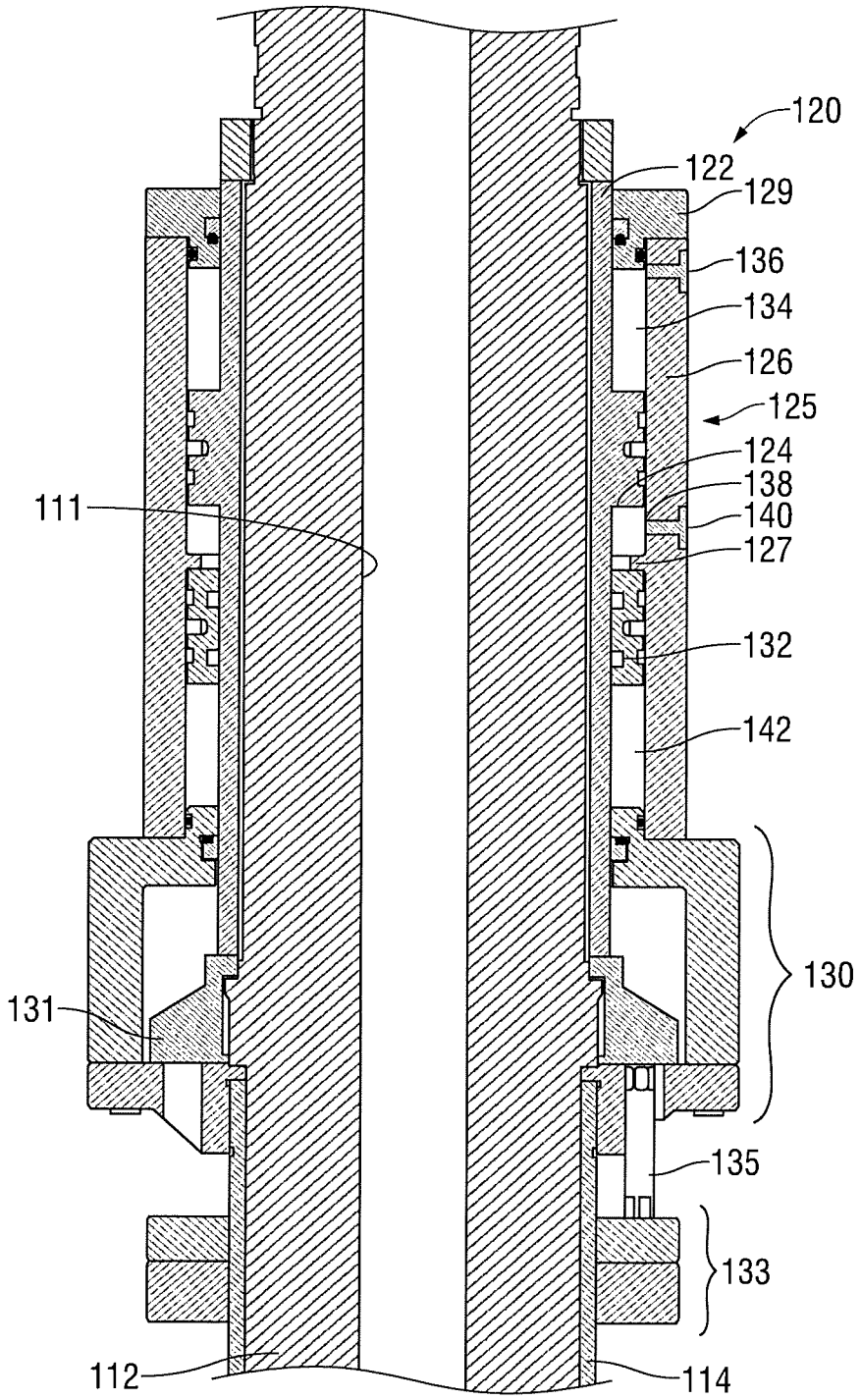
FIG. 3A illustrates an enlarged section view of an embodiment of an actuator assembly in a first position.
Figure 3B:
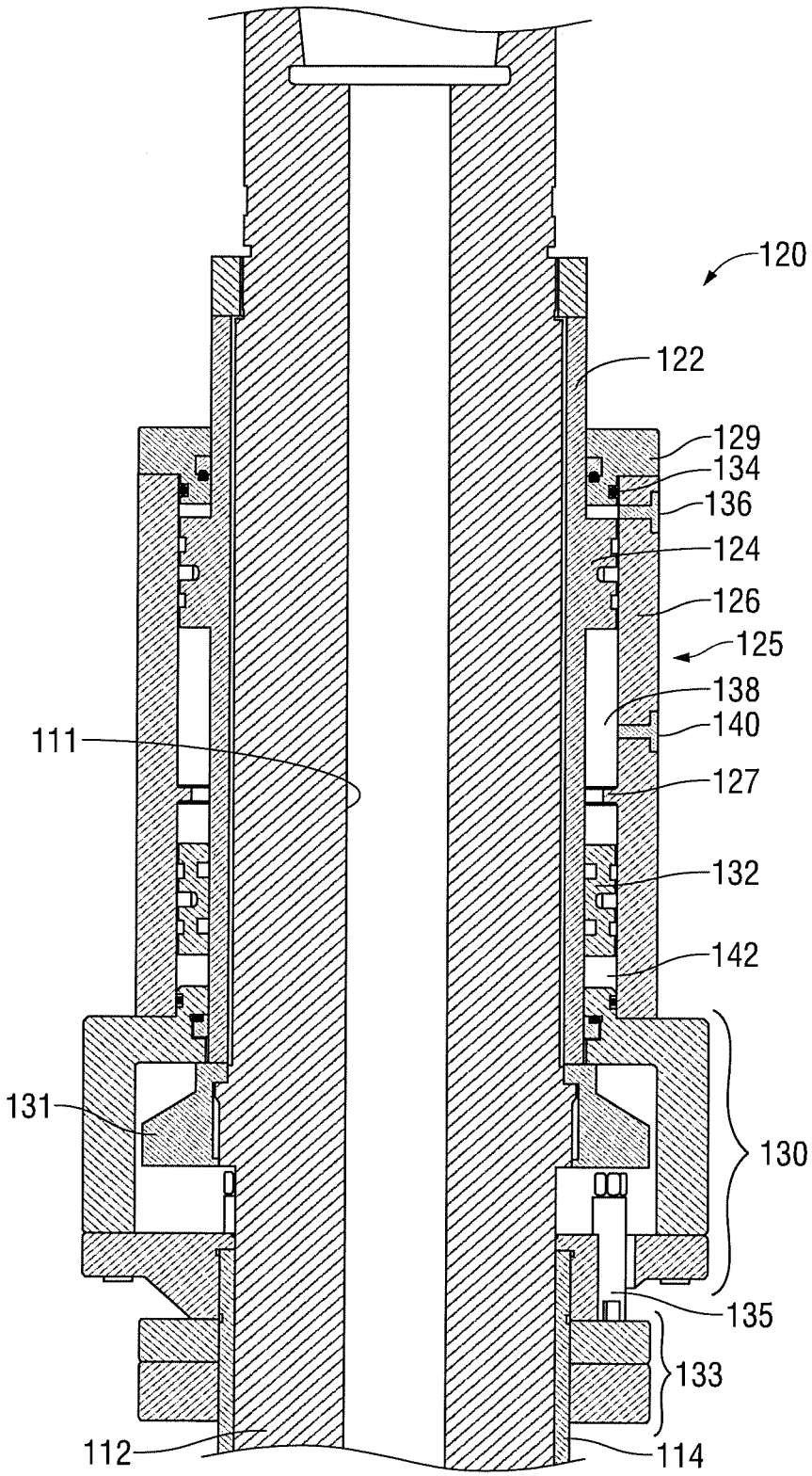
FIG. 3B illustrates an enlarged section view of an embodiment of an actuator assembly in a second position.

FIGS. 3A and 3B illustrate enlarged section views of an embodiment of an actuator assembly 120 for the tubular running device 100. FIG. 3A illustrates the actuator assembly in a first or unset position, that is, a position in which the rolling supports do not engage a tubular. FIG. 3B illustrates the actuator assembly in a second or set position, that is, a position in which the rolling supports engage a tubular. The inner mandrel 112 of the tubular running device extends axially through the actuator assembly 120. The inner mandrel 112 includes a central through bore 111 that extends axially therethrough to allow drilling fluid or mud to be pumped into the tubular OCTG and/or well bore. The actuator assembly 120 includes a series of hydraulic or pneumatic fluid chambers, which when alternately filled with fluid directly move the outer cage 114 relative to the inner mandrel 112. A sleeve 122 is fixed at an upper end and lower end about an outer surface of the inner mandrel 112. The fixed sleeve 122 is configured having an outer circumferential flange 124 protruding radially outward. A movable outer housing assembly 125 includes an outer housing 126 attached between an upper end cap 129 at an upper end and a hub assembly 130 at a lower end. The movable outer housing assembly 125 is disposed concentrically about the fixed sleeve 122 and flange 124. The upper end cap 129 and hub assembly 130 sealingly engage an outer surface of the fixed sleeve 122, and the outer housing 126 sealingly engages an outer surface of the flange 124 of the fixed sleeve 122.

The hub assembly 130 disposed at a lower end of the outer movable housing 126 is coupled either directly or indirectly to the outer cage 114 and is capable of moving the outer cage 114 to travel axially relative to the movement of the inner mandrel 112. A bump stop ring 133 secured or fixed to an outer surface of the outer cage 114 is attached by a plurality of fasteners 135 to a lower portion of the hub assembly 130. The bump stop ring 133 includes two plates fastened together—an upper steel plate and a lower shock-absorbing plate made from a shock-absorbing material such as carbon fiber or similar materials. A mandrel ring 131 is secured or fixed to an outer surface of the inner mandrel 112 and engages a lower end of the fixed sleeve 122. The mandrel ring 131 is configured to limit axial movement of the hub assembly 130 along the length of the inner mandrel 112.

Referring still to FIGS. 3A and 3B, an upper chamber 134 is defined above the flange 124 on the fixed sleeve 122 and below the upper end cap 129, and between the outer surface of the fixed sleeve 122 and the inner surface of the movable outer housing 126. A lower chamber 138 is defined below the flange 124 on the fixed sleeve 122 and above the hub assembly 130, and between the outer surface of the fixed sleeve 122 and the inner surface of the movable outer housing 126. An upper port 136 extends radially through the movable outer housing 126 and provides fluid communication into the upper chamber 134. A lower port 140 extends radially through the movable outer housing 126 and provides fluid communication into the lower chamber 138. The upper port 136 and the lower port 140 may each be fitted with a pilot operated check valve configured to be closed to prevent fluid from exiting the upper chamber and lower pressure, respectively.

A floating piston 132 is disposed in the lower chamber 138 and is configured to move axially therein. A gas chamber 142 is defined below the floating piston 132 and above the hub assembly 130, and between the outer surface of the fixed sleeve 122 and the inner surface of the movable outer housing 126. The gas chamber 142 may be filled or precharged with a gas or gas mixture—such as nitrogen or similar gases—at a certain pressure. A floating piston stop 127, configured as a radially inwardly protruding lip, is illustrated disposed on an inner surface of the movable outer housing 126 configured to limit upward movement of the floating piston 132.

Methods of operating the tubular running device 100 with the actuator assembly 120 described herein include pumping fluid through the lower pressure port 140 and into the lower chamber 138, thereby moving the outer housing assembly 125 in an axial direction downward. In turn, the outer cage 114 is moved downward relative to the inner mandrel 112, and rolling supports 118 are moved simultaneously in axial and radial directions along inclined surfaces of the indentations 116, thereby protruding through openings in the outer cage 114 to engage the tubular OCTG. Pumping fluid through the lower pressure port 140 also forces the floating piston 132 in an axial direction downward, thereby compressing gas therein and pressurizing the gas chamber 142. Once the desired fluid pressure has been reached in the lower chamber 138, fluid ceases to be pumped into the lower chamber 138, which remains pressurized at the desired pressure level due to the closed pilot operated check valve in the lower pressure port 140. The compressed gas in the gas chamber 142 directly acts upon the lower surface of the floating piston 132, upwardly urging the floating 132 piston and providing a continuous set pressure in the lower chamber 138. Moving the outer cage 114 to disengage the rolling supports from the tubular OCTG includes opening the pilot operated check valve in the lower pressure port 140, and pumping fluid through the upper pressure port 136 and into the upper chamber 134, thereby moving the outer housing assembly 125 upward.

The tubular running device further includes a safety control system configured to monitor the set and unset hydraulic or pneumatic pressures present at any given time in the upper and lower chambers, and thereby the position of the rolling supports. The safety control system is also able to monitor feedback loops that include sensors or monitors located to monitor pressures in the upper and lower chambers, and located at other pressure locations of the tubular running device 100. The safety control system may include a processor to collect data readings from the various sensors. A wireless communication link may be used to transmit pressure data readings from the safety control system processor to an operator.

The tubular running device may be coupled with various other devices or equipment on a rig. For example, a hydraulic or pneumatic swivel may be coupled to the tubular running device such that if the top-drive has no swivel function capability a separate member can be added to provide this function, for make-up or breakout operations. In another example, the tubular running device may be coupled to a weight compensation control system whereby the activation of the weight compensation system will provide for the tubular OCTG to be lowered in a controlled fashion into the tubular OCTG already secured in the rotary table on the drill floor and utilizing the weight compensation system will effectively give the tubular OCTG zero weight in gravity and protect the threads of the tubular OCTG during stabbing operations, for make-up or breakout operations.

Advantageously, embodiments described herein provide a actuator assembly for a tubular running device with minimal moving components to provide greater efficiency and torque capability for operating the tubular running device. The actuator assembly removes components required in current systems, including separate hydraulic or pneumatic lines and systems, and a remote control console for operating the hydraulic or pneumatic systems. Rather, the present embodiments have hydraulic or pneumatic chambers built directly into the actuator. The actuator assembly further provides the advantage of having a safety device built directly into the actuator to ensure the tubular running device remains set or engaged at all times.

A tubular running device having the actuator assembly described herein may be used in a number of places. First, as primarily described herein, the tubular running device may be used in the construction of oil and gas wells where it is usually necessary to drill and line the well bore with a string of steel pipes, or OCTG tubulars. Other oil and gas applications may include abandonment or decommissioning of oil and gas wells where it is usually necessary to remove OCTG tubulars, steel structures, pilings, caissons, or pipelines. Yet other applications may include installing anchoring connector systems for offshore drilling establishments. For example, floating drilling rigs in the form of semi-submersibles, spars, and drill ships are often used in deep water drilling activities. These drilling rigs must be anchored or tethered to the sea floor using large suction anchors deployed and placed on the sea floor to remain in position. Large ropes or chains are then attached from the drilling rig to the suction anchors. Yet another application may be in the recovery of damaged or abandoned pipelines from the sea floor. The actuator described herein provides a means to grip the pipeline while being manipulated by a ROV. Yet other applications may be in the placement of columns for wind energy turbines. Still other applications may be in the erection of structures fabricated from tubular members such as offshore platforms, water towers, etc.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A tubular running device comprising a gripping apparatus at a lower end, the gripping apparatus comprising an outer cage concentrically disposed about an inner mandrel and movable relative to the inner mandrel for engaging and disengaging a plurality of rolling supports with a tubular, and an actuator assembly for moving the outer cage, the actuator assembly comprising:

a housing assembly coupled to the outer cage, wherein the housing assembly is movable relative to the inner mandrel;

an upper fluid chamber disposed between the housing assembly and the inner mandrel, and a lower fluid chamber disposed between the housing assembly and the inner mandrel, wherein fluid pumped through an upper pressure port into the upper chamber moves the housing assembly in a first direction thereby causing the gripping apparatus to engage the tubular, and wherein fluid pumped through a lower pressure port into the lower fluid chamber moves the housing assembly in a second direction thereby causing the gripping apparatus to disengage the tubular; and a floating piston disposed within the lower fluid chamber, and a gas chamber defined between the housing assembly and the inner mandrel and below the floating piston, wherein fluid pumped through the lower pressure port into the lower fluid chamber moves the floating piston in the first direction and compresses a gas present in the gas chamber.

2. The actuator assembly of claim 1, further comprising a sleeve fixed to the inner mandrel, the sleeve comprising an outer circumferential flange protruding radially outward to sealingly engage the housing assembly.

3. The actuator assembly of claim 2, wherein the housing assembly comprises an outer housing attached between an upper end cap at an upper end and a hub assembly at a lower end.

4. The actuator assembly of claim 3, wherein the upper fluid chamber is axially defined between the flange on the sleeve fixed to the inner mandrel and the upper end cap, and radially between the outer surface of the fixed sleeve and the inner surface of the movable outer housing.

5. The actuator assembly of claim 3, wherein the lower fluid chamber is axially defined between the flange on the sleeve fixed to the inner mandrel and the hub assembly, and radially between the outer surface of the fixed sleeve and the inner surface of the movable outer housing.

6. The actuator assembly of claim 1, further comprising a mandrel ring secured to the inner mandrel proximate to a lower end of the fixed sleeve, wherein the mandrel ring is configured to limit axial movement of the housing assembly along the length of the inner mandrel.

7. A method of operating a tubular running device comprising a gripping apparatus at a lower end, the gripping apparatus comprising an outer cage concentrically disposed about an inner mandrel and movable relative to the inner mandrel for engaging and disengaging a plurality of rolling supports with a tubular, the method comprising:

providing an actuator assembly for moving the outer cage, the actuator assembly comprising a housing assembly coupled to the outer cage, and an upper fluid chamber defined between the housing assembly and the inner mandrel, and a lower fluid chamber defined between the housing assembly and the inner mandrel;

pumping fluid into the upper chamber and moving the housing assembly axially relative to the inner mandrel in a first direction thereby causing the gripping apparatus to engage the tubular, and moving a floating piston disposed within the lower fluid chamber in the first direction and thereby compressing a gas present in a gas chamber disposed between the housing assembly and the inner mandrel and below the floating piston.

8. The method of claim 7, further comprising pumping fluid into the lower fluid chamber and moving the housing assembly axially relative to the inner mandrel in a second direction thereby causing the gripping apparatus to disengage the tubular.

* * * * *